US007666036B1

(12) United States Patent
Zou

(10) Patent No.: US 7,666,036 B1
(45) **Date of Patent: *Feb. 23, 2010**

(54) STAY LIT SOCKET STRUCTURE FOR LED LIGHT BULBS

(76) Inventor: ChuanBin Zou, Industrial District, ZhongHan Town, ChaoHu, AnHui (CN) 22800

( * ) Notice: Subject to any disclaimer, the term of this patent is extended or adjusted under 35 U.S.C. 154(b) by 0 days.

This patent is subject to a terminal disclaimer.

(21) Appl. No.: 12/387,497

(22) Filed: May 5, 2009

Related U.S. Application Data

(63) Continuation-in-part of application No. 12/284,263, filed on Sep. 22, 2008, now Pat. No. 7,547,237.

(51) Int. Cl.
*H01R 24/00* (2006.01)

(52) U.S. Cl. ..... 439/699.2; 362/653

(58) Field of Classification Search ..... 439/669.2, 439/619, 893, 892; 362/653, 249
See application file for complete search history.

(56) References Cited

U.S. PATENT DOCUMENTS

| | | | | |
|---|---|---|---|---|
| 5,273,452 | A * | 12/1993 | Donato et al. | 439/339 |
| 6,238,062 | B1 * | 5/2001 | Hsu | 362/267 |
| 6,368,161 | B1 * | 4/2002 | Lin | 439/699.2 |
| 6,796,688 | B2 * | 9/2004 | Huang | 362/362 |
| 7,306,360 | B2 * | 12/2007 | Lin | 362/653 |
| 7,547,237 | B1 * | 6/2009 | Zou | 439/699.2 |

* cited by examiner

*Primary Examiner*—Neil Abrams
*Assistant Examiner*—Phuong Nguyen

(57) ABSTRACT

A water proof socket for outdoor light bulbs such as LED light bulbs which comprises a bulb cover housing the light bulb, the bulb cover housing having a neck portion for receiving the light bulb, internally threaded cylindrical member around the neck portion, and an externally threaded cylindrical base at the other end engaged in the internally threaded cylindrical portion. The bulb holder is attached to a seat member with a projecting rectangular member which has two holes with electrical contact passing through each hole. The rectangular member fits snugly in a cavity in said threaded member in said base and external wires pass through the base and makes contact with the internal electrical contacts.

8 Claims, 3 Drawing Sheets

STAY LIT SOCKET STRUCTURE FOR LED LIGHT BULBS

RELATED APPLICATION

The application is a continuation-in-part of application Ser. No. 12/284,263 filed Sep. 22, 2008 now U.S. Pat. No. 7,547,237.

FIELD OF THE INVENTION

This invention relates to a socket structure for holding light bulbs, such as, LED decorative light bulbs, and is particularly related to a water proof socket structure for such light bulbs. In a particular aspect, this invention provides a uniquely designed socket structure for use in a string of lights which insures that the string of lights remain illuminated even when illumination is lost in one or more of the bulbs in the light string.

BACKGROUND OF THE INVENTION

Decorative light bulbs are frequently used for outdoor decoration. The light bulbs are often miniature bulbs strung on a string, in series, and used outdoors on Christmas trees, plants and other structures. Outdoor exposure exposes the light bulbs to rain which penetrates inside the socket, damaging the conductors and shorts out the light bulbs.

A variety of socket structures have been disclosed in the prior art for protecting outdoor decorative light bulbs from damage due to water penetration into the socket. Representative recent patents and patent publications includes U.S. Pat. No. 5,620,343 issued Apr. 15, 1997; U.S. Pat. No. 5,672,077 issued Sep. 20, 1997; U.S. Pat. No. 5,720,544 issued Feb. 24, 1998; U.S. Pat. No. 5,722,860 issued Mar. 3, 1998; U.S. Pat. No. 6,368,161 B1 issued Apr. 9, 2002 and Publication No. US 2007/0230168 A1 published Oct. 4, 2007; Publication No. US 2004/0150998 A1 published Aug. 5, 2004 and Publication No. US 2003/0202354 A1 published Oct. 30, 2003.

SUMMARY OF THE INVENTION

A waterproof socket is provided for outdoor electrical light bulbs such as the types used for Christmas and outdoor decorations, and specifically for LED light bulbs. The socket structure comprises a bulb cover housing a light bulb, the bulb cover having a neck portion for receiving the light bulb, internally threaded cylindrical member around the neck portion, with the neck portion of the light bulb cover being snug fitted into tight engagement with the cylindrical member, and an externally threaded cylindrical plastic base is provided at the other end which threadedly engages with the threaded portion of said internally threaded member. The bulb holder is integrally formed onto a seat member, said seat member having a rectangular member projecting therefrom. The projecting rectangular member has a bottom surface with two spaced holes and an electrical contact passing through each hole. The rectangular member is constructed to snugly fit into a cavity formed in the threaded member of said base. External electrical wires are passed through said base and make contact with said electrical contacts.

According to another embodiment of the invention, the socket structure is designated to maintain the string of lights illuminated even when one or more of the bulbs loses electrical contact with the light string. Continuous illumination is assured by providing the socket with component elements which provide electrical contact so that all that may be necessary is to replace the bulb. This structure comprises a plastic body casing or cover, having a top and a bottom surface, a bulb cover retained on the top surface, a pair of spaced apart electrical wires protruding from the bottom surface and a pair of electrical leg contacts having their proximal ends in contact with the electric bulbs and their terminal ends in contact with metal clamps which are clamped onto the respective wires. Retained within the socket structure of this embodiment of the invention is an electrical element such as, e.g., resistor, inductor or voltage stabilizer, having spaced apart protruding metal contacts which connect with or contact the legs of the aforementioned distal contact in order to establish electrical communication with the bulbs.

BRIEF DESCRIPTION OF THE DRAWINGS

In the drawings wherein like reference numerals designate like parts

DETAILED DESCRIPTION OF THE INVENTION

Figure 1:
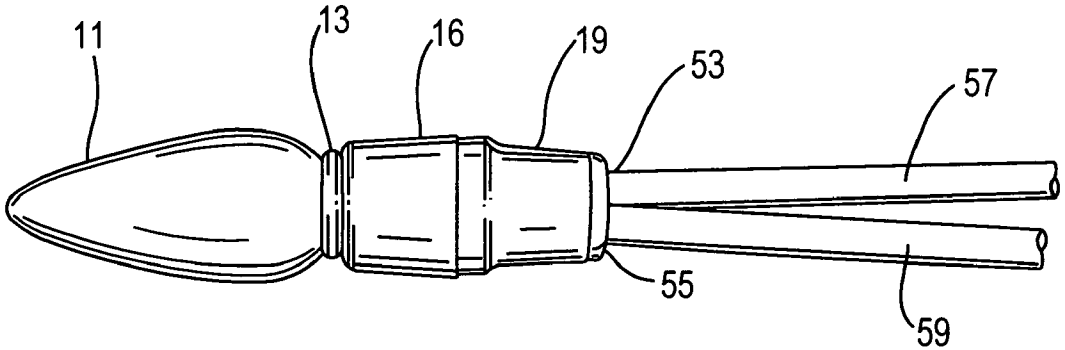
FIG. 1 is a schematic side view of the bulb cover and socket of this invention showing electrical wires protruding from the base of the socket.
Figure 2:
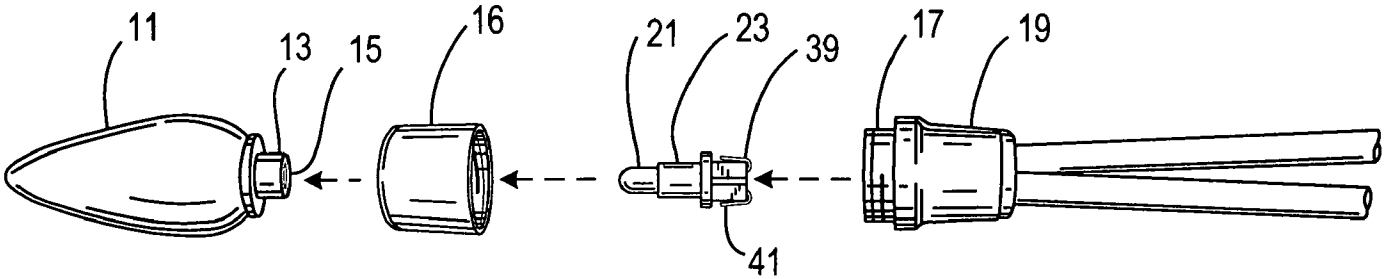
FIG. 2 is an exploded schematic side view of the components of the bulb and socket shown in FIG. 1.
Figure 6:
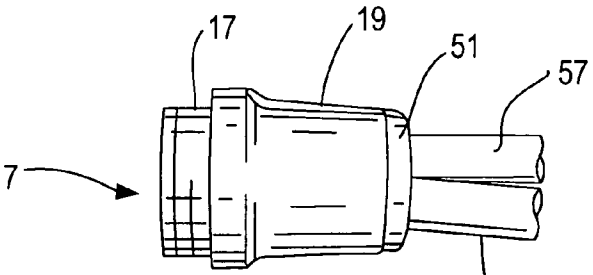
FIG. 6 is a schematic side view of the base structure of the socket shown in FIG. 1.
Figure 7:
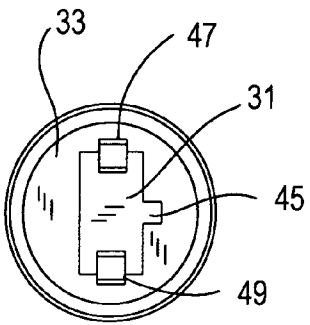
FIG. 7 is a side view looking into the base shown in FIG. 6, in the direction of the arrow 7.
Figure 5:
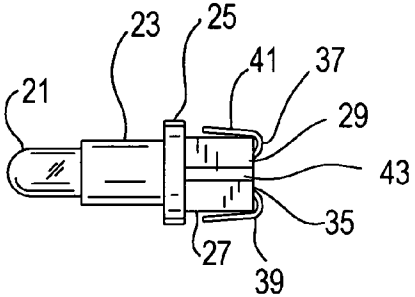
FIG. 5 is a side view of the bulb assembly, LED and the electrical contacts.
Figure 3:
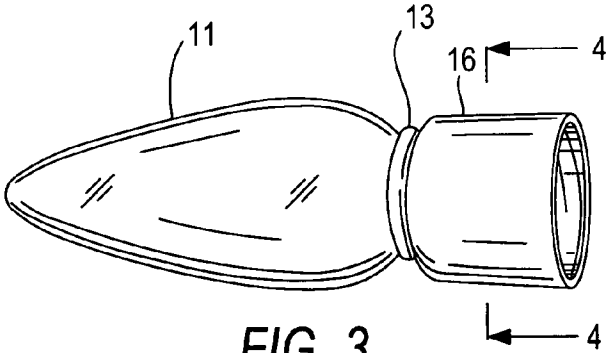
FIG. 3 is a schematic side view of the bulb covering and bulb cover of the present invention.
Figure 4:
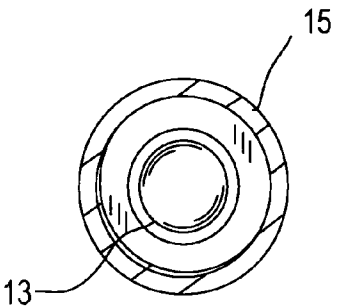
FIG. 4 is a sectional view taken along the line 4-4 in FIG. 3 viewed in the direction of the arrows 4,4.

Referring to the drawings, there are shown a bulb covering 11 having a lower integral base 13, a neck portion 15 adapted to receive a light bulb 21, and a generally cylindrical internally threaded plastic portion 16 into which said neck portion 13 is snugly filled. The internally threaded plastic base portion 16 is adapted to be threadedly engaged with the threaded portion 17 of the plastic base 19 shown in FIG. 6. The bulb cover 11 may be made of a clear or translucent plastic to transmit the light from the light bulb 21, such as an LED, and is secured within the light bulb holder 23 which is integrally attached to one surface of the seat 25. Projecting from the opposed surface of the seat 25 is a plastic generally rectangular member 27, having a bottom surface 29 which is shaped for ready insertion into a shaped cavity 31 formed at the top surface 33 of the base 19. The bottom surface of the projecting plastic member 27 has two spaced apart holes 35 and 37 for passage of the electrical contacts 39 and 41, respectively. An elongated ridge 43 in the member 27 facilitates insertion of the member 27 into the shaped cavity 31 through the notched groove 45 formed on one side of cavity 31. The notched groove 45 in the shaped cavity 31 is sized to matingly engage the ridge 43 to provide a leak proof structure. The electrical contacts 39 and 41 contact the respective electrical contacts 47 and 49 inside each end of the shaped cavity 31. The outer end 51 surface of the base 19 is snugly fitted onto the electrical wires 57,59 as at 53,55. The wires 57 and 59 are sized and shaped so as to permit the passage of the wires 57 and 59 through the base 19 tightly so as to prevent water from penetrating therethrough. The inside ends of the wires 57 and 59 contact the electrical contacts 47 and 49 and also establish electrical contacts with the contacts 39 and 41 thus illuminating the LED 21 when the wires 57 and 59 are connected to an external electrical source (not shown).

The foregoing socket structure provides assurance that when the light bulbs are exposed to rain and snow water will not penetrate through the socket structure. While the socket structure has been described with certain degree of particularity, obvious modification in said structure may be made which are suggested by the disclosure herein.

For example, the base 19 may be molded onto the wires 57 and 59 so as to form an integral structure on the end of the base 19 may be squeeze fitted, e.g., clamped onto the wires 57 and 59 in order to prevent any possibility of water passing through the base.

Figure 8:
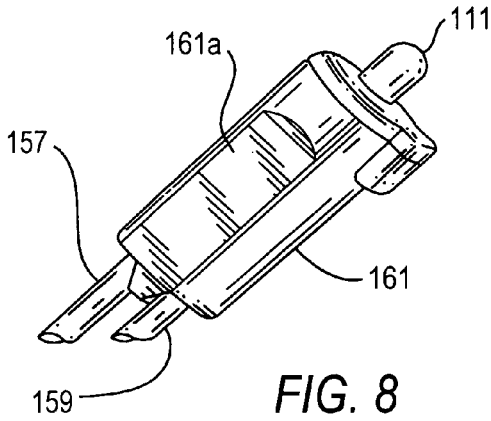
FIG. 8 is a top side view, disposed slightly at an angle, of the socket structure of the different embodiment of this invention.

As it was previously mentioned in a different embodiment of the invention, the socket structure is designed in order to assure continued illumination of the light bulbs in the string of lights even if one socket is breached by intrusion of water from rain or other outer sources. Thus referring to FIG. 8, the socket structure comprises a generally rectangular cylindrical body portion 161 made of plastic or suitable insulating material having a top surface at one end adapted to be connected to or receive a light bulb such as light bulb 111. A pair of spaced apart electrical wires 157,159 protrude from the end of the body portion 161. The surface 161*a* of the body 161 is recessed for ease of grip between the fingers. Additional details of the structure of the embodiment of the socket are shown in FIGS. 9-11.

Figure 9:
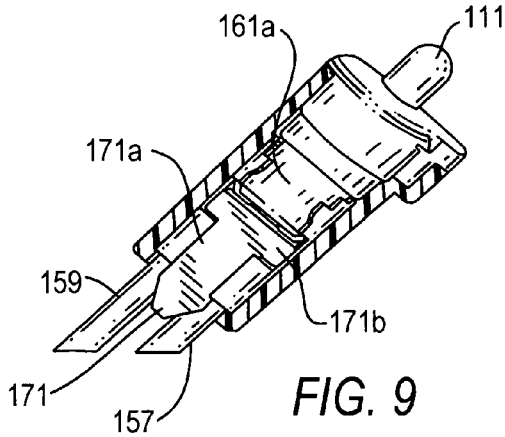
FIG. 9 is a partially sectional top view of the embodiment shown in FIG. 8.
Figure 10:
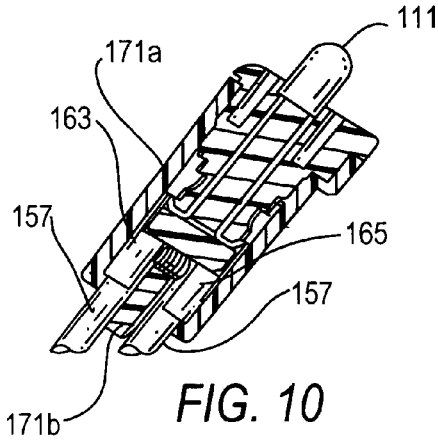
FIG. 10 is a longitudinal sectional view of the socket structure shown in FIG. 8.
Figure 11:
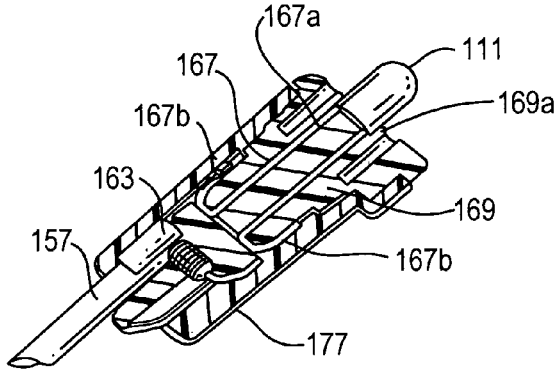
FIG. 11 is another view similar to FIG. 10.
Figure 12:
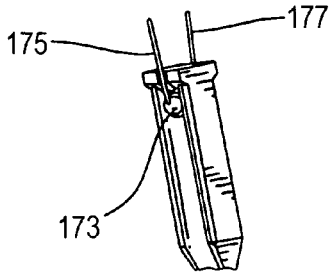
FIG. 12 is a side view of metal contact part with protruding metal contacts.

Referring now to FIGS. 9-12, there are shown a pair of conductive wire clamps 163,165, each being clamped onto the respective electrical wires 157,159. Disposed within the body 161, in spaced apart generally parallel position, are electrical contact legs 167,169, having their proximal terminals 167*a*,169*a* contacting the electrical bulb 111 and their proximal terminals 167*b* and 169*b* shaped in a generally U-shape configuration. Each of the distal terminal 167*b*,169*b* is in contact with the opposite ends of each of the clamps 163,165. In order to provide a socket structure having the advantages of the present invention, a plastic water stopper 171 is disposed in the body 161 as shown in FIG. 9, in the form of a generally T-shaped member defined by the longer member 171*a* and the cross member 171*b*. An electric element 173 such as a resistor, inductor or a voltage stabilizer, within the T-shaped water stopper 171 is conveniently located as shown in FIGS. 10 and 11. Two metal contacts 175,177 protrude from the opposed ends of the element 173, extend through the cross member of the water stopper and contact the electrical legs 167,169 to complete the electrical connection. If water seeps through the body 161, one of these contacts may be disconnected to discontinue illumination of the bulb in this socket structure only, without interrupting illumination in the remaining light bulbs in the string of lights.

The invention claimed is:

1. A waterproof socket for light bulbs comprising:

a bulb cover having a neck portion for receiving a light bulb, a generally cylindrical partly internally threaded member snugly fitted onto said neck portion, a generally cylindrical base having a threaded end to threadedly engage with said generally cylindrical member, a generally rectangular shaped cavity in said threaded end of said cylindrical base, an electrical bulb and a bulb holder for said bulb, said bulb holder projecting from a seat member, a generally rectangular sealing member projecting from the other surface of said seat member said rectangular member having electrical contacts at each side, and wherein said rectangular member is snugly engaged into said cavity to prevent passage of water through said member.

2. A water proof socket structure as in claim 1 further including two spaced apertures in said base and a pair of electrical wires, each of said wires passing through each aperture to establish electrical contact with said light bulb.

3. A water proof socket structure as in claim 2 wherein said pair of electrical wires pass through said base such that said base is snugly fitted onto said wires to prevent passage of water through said base.

4. A water proof socket as in claim 3 wherein said base is molded onto said wires to form an integral water proof structure.

5. A waterproof socket structure for light bulbs comprising:

a bulb cover having a neck portion for receiving a light bulb, a generally cylindrical partly internally threaded member snugly fitted onto said neck portion a generally cylindrical base having a threaded end to threadedly engage with said generally cylindrical member, a generally rectangular shaped cavity in said threaded end of said cylindrical base, an electrical bulb and a bulb holder for said bulb, a generally cylindrical sealing body having a top surface and an opposed bottom surface, the light bulb within said top surface and a pair of electrical wires protruding from said bottom surface, a pair of conductive wire clamps, each being clamped onto a respective conductive wire, a pair of conductive wire legs having two ends, one end connected to said bulb and the other end connected to said wire clamp and an electric element in said body portion, said electrical element having spaced apart electrical contacts, each electrical contact contacting a respective wire leg in said body portion.

6. A socket structure as in claim 5 further including an insulative T-shaped member defined by generally elongated portion and a cross member, and wherein said electrical element is disposed within said insulative T-shaped member, and wherein said electrical contacts protrude from said electrical element through said cross member to contact said wire legs.

7. A socket structure as in claim 5 wherein said electrical element is a resistor, inductor or voltage stabilizer.

8. A socket structure as in claim 6 wherein said electrical element is a resistor, inductor or voltage stabilizer.

* * * * *